US008013539B2

(12) United States Patent
Newman et al.

(10) Patent No.: US 8,013,539 B2
(45) Date of Patent: Sep. 6, 2011

(54) LOW-COST DRIVE SYSTEM FOR AN LED TRIAD

(75) Inventors: Timothy J. Newman, Noblesville, IN (US); Craig A. Tieman, Westfield, IN (US); Steven G. Skiver, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 512 days.

(21) Appl. No.: 12/229,240

(22) Filed: Aug. 21, 2008

(65) Prior Publication Data

US 2010/0045207 A1 Feb. 25, 2010

(51) Int. Cl.
*H05B 41/36* (2006.01)

(52) U.S. Cl. ..... 315/291; 315/210; 315/226

(58) Field of Classification Search ..... None
See application file for complete search history.

(56) References Cited

U.S. PATENT DOCUMENTS

| | | | | |
|---|---|---|---|---|
| 6,016,038 | A | 1/2000 | Mueller et al. | |
| 6,575,607 | B1 | 6/2003 | Klemish et al. | |
| 6,717,376 | B2 | 4/2004 | Lys et al. | |
| 7,327,337 | B2 * | 2/2008 | Callahan | 345/82 |
| 2004/0178751 | A1 | 9/2004 | Mueller et al. | |
| 2009/0261750 | A1 * | 10/2009 | Hsueh et al. | 315/291 |

* cited by examiner

*Primary Examiner* — Douglas W Owens
*Assistant Examiner* — Dedei K Hammond
(74) *Attorney, Agent, or Firm* — Jimmy L. Funke

(57) ABSTRACT

A drive system for powering LED triads includes a controller for supplying power to one or more LED triad modules with integral encoding of the desired hue and intensity information. The LED triad modules each include an LED triad and decoding circuitry for activating the individual LED elements of the triad according to the encoded hue and intensity information. In the illustrated configuration, the controller supplies power to the LED triad modules over a pair of conductors, and the supplied power is modulated using a four-phase encoding sequence that is decoded by the decoding circuitry of each LED triad module so that each LED triad module produces light of the desired hue and intensity.

6 Claims, 3 Drawing Sheets

LOW-COST DRIVE SYSTEM FOR AN LED TRIAD

TECHNICAL FIELD

The present invention relates to the provision of color lighting with a triad of red, green and blue light emitting diodes (LEDs), and more particularly to a low-cost drive system for controlling the hue and intensity of the emitted light.

BACKGROUND OF THE INVENTION

LEDs have been utilized in many monochrome lighting applications, and various manufacturers are now co-packaging triads of red, blue and green LEDs for applications where color control is desired. With such an LED triad, the hue of the emitted light is changed by varying the proportion of drive current among the red, green and blue LEDs, and the intensity of the emitted light is changed by varying the overall drive current while maintaining the proportionality of the individual red, green and blue drive currents.

While color control is often deemed to be desirable, the cost of introducing color controllable LEDs in traditionally monochrome applications can be cost prohibitive due to the increase in the number of wires required to address the individual LED devices. Instead of the traditional two wires needed for a monochrome lamp (incandescent or LED), four wires are ordinarily needed for an LED triad. This can be a particular disincentive in applications that require many lighting locations, such as in automotive interior lighting. Accordingly, what is needed is a drive system that reduces the wiring complexity required to control LED triads so that color controllable LEDs can be used more cost-effectively in a variety of applications.

SUMMARY OF THE INVENTION

The present invention is directed to an improved drive system for powering LED triads, including a controller for supplying power to one or more LED triad modules with integral encoding of the desired hue and intensity information. The LED triad modules each include an LED triad and decoding circuitry for activating the individual LED elements of the triad according to the encoded hue and intensity information. In the illustrated embodiment, the controller supplies power to the LED triad modules over a pair of conductors, and the supplied power is modulated using a four-phase encoding sequence that is decoded by the decoding circuitry of each LED triad module so that each LED triad module produces light of the desired hue and intensity.

DESCRIPTION OF THE PREFERRED EMBODIMENT

Figure 1:
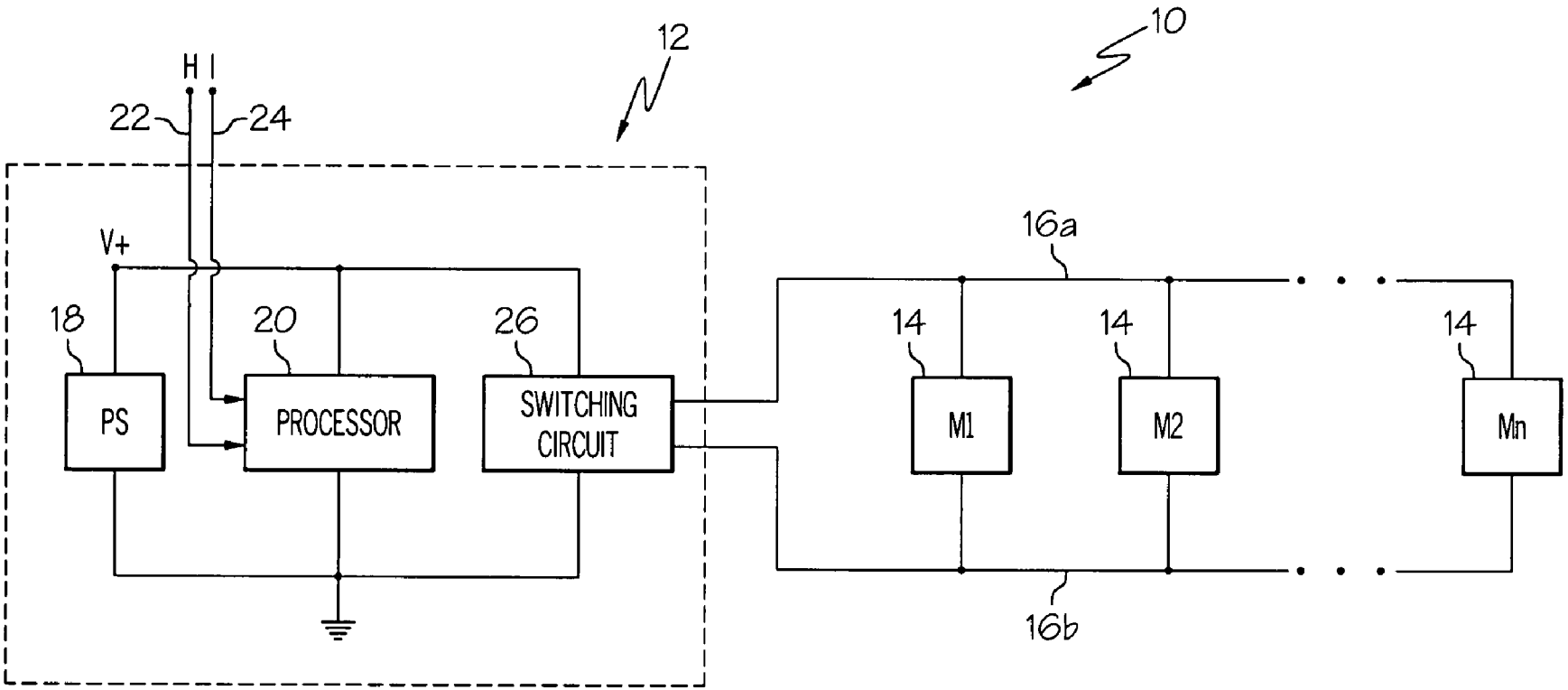
FIG. 1 is a block diagram of an LED triad drive system according to the present invention, including a controller and a number of LED triad modules.

Referring to the drawings, and particularly to FIG. 1, the reference numeral 10 generally designates an LED triad drive system including single controller 12 that supplies power to an unspecified number of parallel-connected LED triad modules 14 (M1, M2 . . . Mn) via first and second conductors 16*a* and 16*b*. The controller 12 includes a DC power supply 18, a processor 20 that receives hue and intensity input signals (H, I) on lines 22 and 24, and a switching circuit 26 for coupling the power supply 18 to the conductors 16*a* and 16*b*. Each LED triad module 14 includes a set of three co-packaged red, green and blue LEDs and decoding circuitry for coupling the individual LEDs to the conductors 16*a* and 16*b*.

In general, the processor 20 and switching circuit 26 of controller 12 constitute an encoder for modulating the power supplied to the LED triad modules 14 based on the hue and intensity inputs, and decoding circuitry in each LED triad module 14 decodes the hue and intensity information and correspondingly activates the individual LEDs. While a particularly cost-effective encoding arrangement is described herein, it should be understood that the present invention is not limited to the disclosed arrangement, and that other suitable encoding/decoding arrangements and circuits can be devised by those skilled in the art. For example, it is possible to encode the hue and intensity information so that one of the two conductors 16*a*, 16*b* can be referenced to same ground potential as controller 12; in that case, the ground conductor may be eliminated by referencing the controller 12 and each of the LED triad modules 14 to a common ground potential, such as a conductive frame on which the controller 12 and LED triad modules 14 are mounted.

Figure 2:
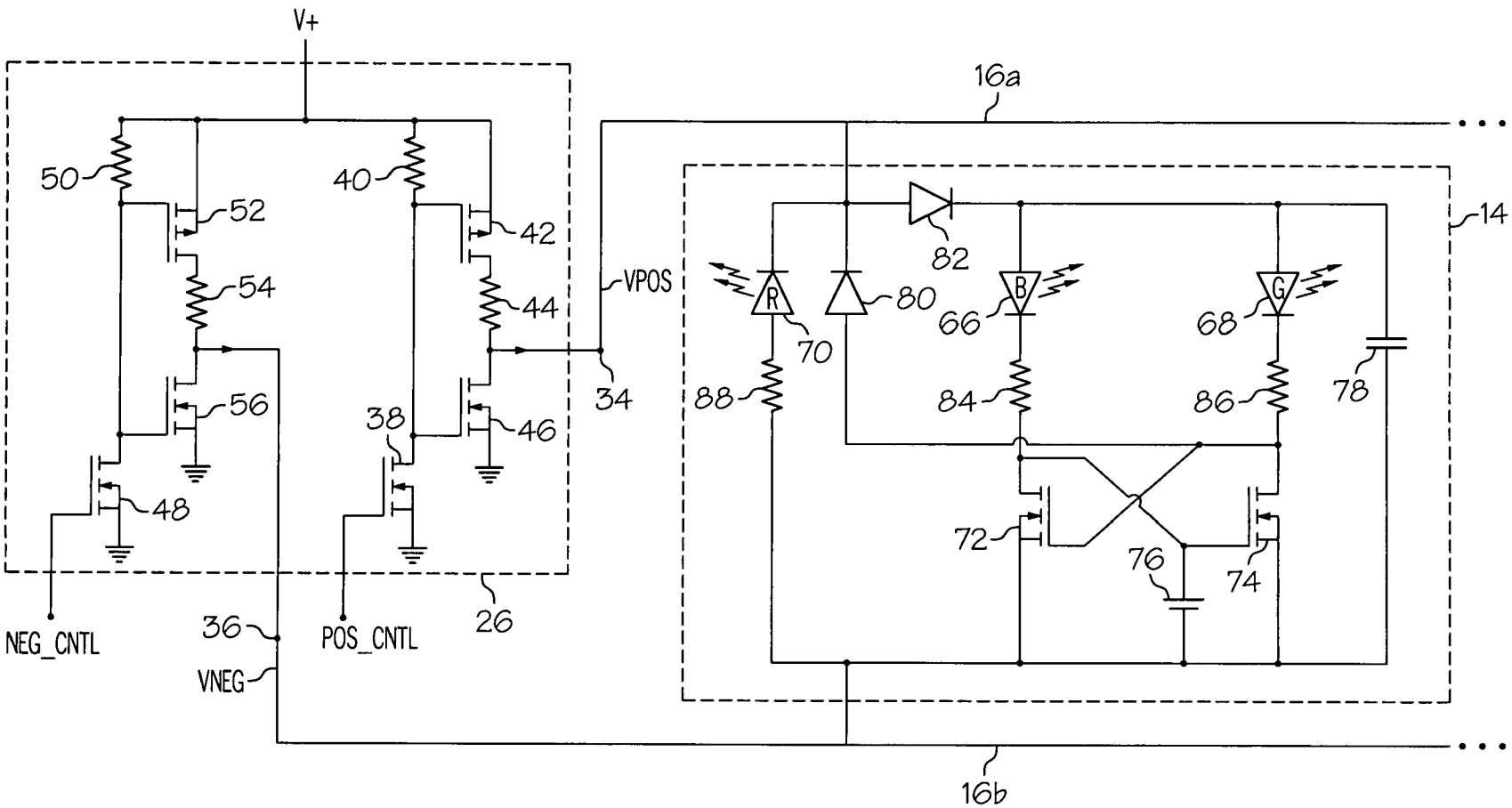
FIG. 2 is a circuit diagram of a bridge circuit of the controller and one of the LED triad modules.
Figure 3A:
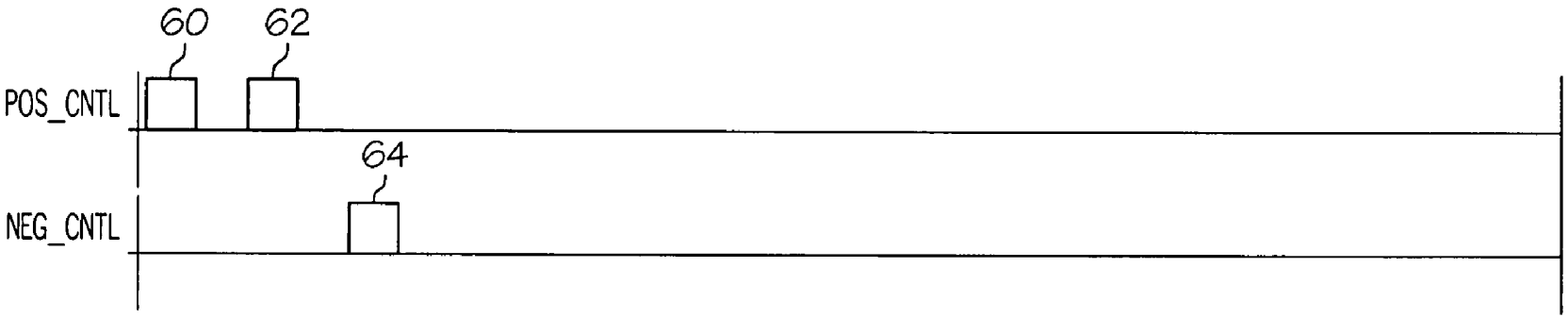
FIGS. 3A and 3B are exemplary timing diagrams for controlling the bridge circuit of FIG. 2.
Figure 3B:
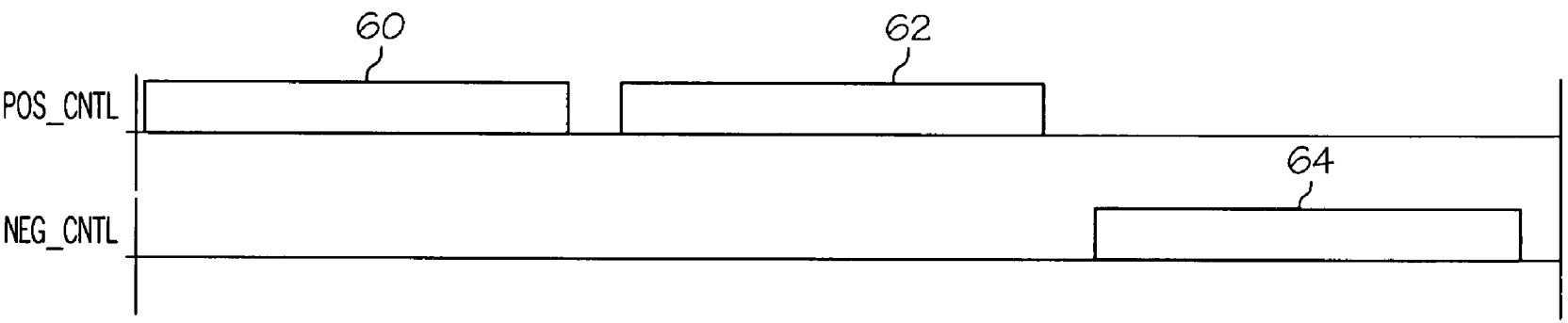

FIGS. 2 and 3A-3B depict circuitry for implementing a preferred encoding/decoding scheme for the LED triad drive system 10 of FIG. 1. Referring to FIG. 2, the switching circuit 26 is configured as a full H-bridge that is pulse-width modulated by processor 20 via the inputs POS_CTRL and NEG_CTRL to define a four-phase encoding sequence that is decoded by each LED triad module 14. The specific four-phase encoding sequence in the illustrated embodiment comprises a variable negative pulse for each red LED, a first variable positive pulse for each blue LED, a second variable positive pulse for each green LED, and a variable off interval. The repetition frequency of the sequence is sufficiently high (preferably 120 Hz or higher) so that there is no noticeable flicker due to the pulse modulation. Of course, it will be understood that the color order and pulse polarities of the encoding sequence are arbitrary, and may be different than shown.

The H-bridge outputs at terminals 34 and 36, designated as VPOS and VNEG, are respectively connected to the conductors 16*a* and 16*b* so that the POS_CNTL and NEG_CNTL inputs control their relative polarity. When POS_CNTL is active (high), conductor 16*a* is coupled to the V+ terminal of power supply 18 via the VPOS output terminal 34 of switching circuit 26, and conductor 16*b* is coupled to the controller ground via the VNEG output terminal 36 of switching circuit 26. When NEG_CNTL is active (high), conductor 16*b* is coupled to the V+ terminal of power supply 18 via the VNEG output terminal 36, and conductor 16*a* is coupled to the controller ground via the VPOS output terminal 34.

The positive leg of switching circuit 26 includes an n-channel control transistor 38 gated on and off by the POS_CNTL input, a pull-up resistor 40, a p-channel transistor 42 coupling the output terminal 34 to V+ via resistor 44, and an n-channel transistor 46 coupling the output terminal 34 to controller ground. When the POS_CNTL input is low, transistor 46 conducts to couple output terminal 34 (and conductor 16*a*) to controller ground; and when POS_CNTL input is high, transistors 38 and 42 conduct to couple output terminal 34 (and conductor 16*a*) to V+.

The negative leg of switching circuit 26 includes an n-channel control transistor 48 gated on and off by the NEG_CNTL input, a pull-up resistor 50, a p-channel transistor 52 coupling the output terminal 36 to V+ via resistor 54, and an n-channel transistor 56 coupling the output terminal 36 to controller ground. When the NEG_CNTL input is low, transistor 56 conducts to couple output terminal 36 (and conductor 16*b*) to controller ground; and when NEG_CNTL input is high, transistors 48 and 52 conduct to couple output terminal 36 (and conductor 16*b*) to V+.

The variable negative pulse for activating the red LEDs is triggered by a high interval of NEG_CNTL, the first variable positive pulse for activating the green LEDs is triggered by a first high interval of POS_CNTL, the second variable positive pulse for activating the blue LEDs is triggered by a second high interval of POS_CNTL, and the variable off interval is corresponds to an interval where both POS_CNTL and NEG_CNTL are low. Obviously, the POS_CNTL and NEG_CNTL inputs cannot be high at the same time, and in fact, dead time intervals (22 microseconds, for example) are imposed between the red, green and blue control pulses to ensure there is no overlap.

The above-described pulse sequence of POS_CNTL and NEG_CNTL for one cycle of the 120 Hz control pulse waveform is graphically illustrated in the timing diagrams of FIGS. 3A and 3B. The four-phase sequence in any given cycle includes a blue activation interval signified by the first POS_CNTL pulse 60, a green activation interval signified by the second POS_CNTL pulse 62, a red activation interval signified by the NEG-CNTL pulse 64, and an off interval during which both POS_CNTL and NEG_CNTL are low. FIG. 3A depicts a minimum intensity condition in which the activation and off intervals are set to a prescribed minimum time such as 22 microseconds. FIG. 3B, on the other hand, depicts a maximum intensity condition in which the activation intervals are set to a prescribed maximum time equal to nearly one-third of the cycle period. In both examples, the emitted light is white because the blue, green and red activation intervals are equal; changing the color of the emitted light simply involves changing the proportionality of the blue, green and red intervals. For example, the emitted light will be green when the blue and red activation intervals are set to the prescribed minimum intensity, and so on.

Returning to FIG. 2, each of the LED modules 14 includes an LED triad and decoding circuitry for decoding the above-described four-phase pulse sequence. In other words, the LED modules 14 are configured so that blue, green and red LED 66, 68, 70 are respectively activated during the blue, green and red activation intervals. The red LED 70 is poled such that it will be forward biased when the NEG_CNTL input is high, while the blue and green LEDs 66 and 68 are oppositely poled, and therefore reverse biased when the NEG_CNTL input is high. When the POS_CNTL input is high, the red LED 70 is reverse biased, and a steering circuit including a pair of cross-coupled transistors 72, 74, a pair of capacitors 76, 78 and a pair of diodes 80, 82 determine which of the blue and green LEDs 66, 68 will be forward biased. When the first POS_CNTL pulse of a given LED activation sequence occurs, the capacitor 76 suppresses the gate voltage of transistor 74 to ensure that transistor 72 turns on first. Once transistor 72 turns on, it holds the cross-coupled transistor 74 off. Meanwhile, capacitor 78 charges through diode 82. Accordingly, the blue LED 66 is forward biased during first POS_CNTL pulse, but not the green LED 68. In the dead time interval between the first and second POS_CNTL pulses, the gate of transistor 72 is discharged though diode 80 to turn off transistor 72. The capacitor 78 is prevented from discharging due to diode 82, and maintains a forward voltage across transistor 74. When the second POS_CNTL pulse occurs, transistor 74 immediately turns on, and then holds the cross-coupled transistor 72 off. Accordingly, the green LED 68 is forward biased during second POS_CNTL pulse, but not the blue LED 66. At the end of the second POS_CNTL pulse, the dead time and ensuing NEG_CNTL pulse reset the decoding circuitry so that the above-described operation will be repeated in the next cycle.

In summary, the drive system of the present invention provides a novel and cost-effective way of driving one or more LED triads with a single controller and reduced wiring complexity. When the drive system is used to drive a plurality of LED triad modules 14 as shown in FIGS. 1-2, module-to-module hue and intensity variability due to variation in photonic efficiency of the individual LEDs is minimized by performance-binning the LED elements and then accounting for the remaining efficiency variations by judiciously selecting the resistance values of the resistors 84, 86 and 88 connected in series with the blue, green and red LEDs 66, 68 and 70.

While the present invention has been described with respect to the illustrated embodiment, it is recognized that numerous modifications and variations in addition to those mentioned herein will occur to those skilled in the art. Accordingly, it is intended that the invention not be limited to the disclosed embodiment, but that it have the full scope permitted by the language of the following claims.

The invention claimed is:

1. Drive apparatus for at least one triad of first, second and third LEDs, comprising:

a controller including a power supply, a processor responsive to inputs indicative of desired hue and intensity, and a power encoding circuit activated by the processor to encode data corresponding to the desired hue and intensity on a voltage output of the power supply; and decoding circuitry co-packaged with each triad of first, second and third LEDs and coupled to the data-encoded voltage output of the power supply for decoding the data encoded by the processor and power encoding circuit, and producing separate drive signals for the first, second and third LEDs to produce light of the desired hue and intensity, wherein the power encoding circuit is a switching circuit that encodes the data corresponding to the desired hue and intensity as a periodic sequence of voltage pulses, wherein the periodic sequence of voltage pulses include first, second and third voltage pulses corresponding to desired activation intervals of the first, second and third LEDs, respectively.

2. The drive apparatus of claim 1, wherein one of the first, second and third voltage pulses has a polarity that is negative with respect to the other of the first, second and third voltage pulses.

3. The drive apparatus of claim 2, wherein two of the first, second and third voltage pulses are of the same polarity and occur in succession with an intervening dead time, and the decoding circuitry includes a bistable switch for distinguishing between said two voltage pulses and producing drive signals for the respective LEDs.

4. Drive apparatus for at least one triad of first, second and third LEDs, comprising:

a controller including a power supply, a processor responsive to inputs indicative of desired hue and intensity, and a power encoding circuit activated by the processor to encode data corresponding to the desired hue and intensity on a voltage output of the power supply; and decoding circuitry co-packaged with each triad of first, second and third LEDs and coupled to the data-encoded voltage output of the power supply for decoding the data encoded by the processor and power encoding circuit, and producing separate drive signals for the first, second and third LEDs to produce light of the desired hue and intensity, wherein each triad of first, second and third LEDs and co-packaged decoding circuitry constitute an LED module, and the data-encoded voltage output of the power supply is coupled to a plurality of LED modules in parallel by a pair of conductors.

5. The drive apparatus of claim 4, wherein each LED module includes circuit elements that compensate for photonic efficiency variations among the LEDs to minimize module-to-module hue and intensity differences in the produced light.

6. The drive apparatus of claim 5, wherein the circuit elements that compensate for photonic efficiency variations comprise calibrated resistances in series with the first, second and third LEDs of each LED module.

* * * * *